US006408451B1

(12) United States Patent
Carn et al.

(10) Patent No.: US 6,408,451 B1
(45) Date of Patent: Jun. 25, 2002

(54) BIDET APPARATUS

(76) Inventors: Wayne J. Carn; Russell J. Sawford, both of 103 Norrie Avenue, Whyalla Norrie 5608 (AU)

( * ) Notice: Subject to any disclaimer, the term of this patent is extended or adjusted under 35 U.S.C. 154(b) by 0 days.

(21) Appl. No.: 09/844,771

(22) Filed: Apr. 27, 2001

(51) Int. Cl.[7] ..... E03D 11/02
(52) U.S. Cl. ..... 4/420.2
(58) Field of Search ..... 4/420.2; 392/485, 392/492

(56) References Cited

U.S. PATENT DOCUMENTS 3,947,899 A * 4/1976 Robinson et al. ..... 4/420.2 X
4,592,382 A 6/1986 Rubin et al.
4,926,509 A 5/1990 Bass
5,090,067 A 2/1992 Cogdill
5,142,711 A 9/1992 Parikh
5,170,462 A * 12/1992 Park ..... 4/420.2
5,271,104 A 12/1993 Latora
5,272,774 A * 12/1993 Inko et al. ..... 4/420.2
D355,246 S 2/1995 Kawamura et al.
6,094,524 A * 7/2000 Riley ..... 392/485

* cited by examiner

*Primary Examiner*—Charles E. Phillips

(57) ABSTRACT

A bidet apparatus for cleaning and sanitation purposes. The bidet apparatus includes an elongated pipe having a first end and a second end. The first end is fluidly coupled to a water supply pipe. The second end is positioned in a bowl portion of a toilet bowl such that the second end is directed relatively upwardly out of the bowl portion. A nozzle is attached to the second end of the elongated pipe. An actuator valve selectively opens and closes water flow to the elongated pipe. The actuator is attached to a water supply pipe and comprises a valve.

20 Claims, 5 Drawing Sheets

BIDET APPARATUS

BACKGROUND OF THE INVENTION

1. Field of the Invention

The present invention relates to bidets and more particularly pertains to a new bidet apparatus for cleaning and sanitation purposes.

2. Description of the Prior Art

The use of bidets is known in the prior art. More specifically, bidets heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,090,067; 5,271,104; 5,142,711; 4,592,382; 4,926,509; and U.S. Des. Pat. No. 355,246.

While these devices fulfill their respective, particular objectives and requirements, the aforementioned patents do not disclose a new bidet apparatus. The inventive device includes an elongated pipe having a first end and a second end. The first end is fluidly coupled to a water supply pipe. The second end is positioned in a bowl portion of a toilet bowl such that the second end is directed relatively upwardly out of the bowl portion. A nozzle is attached to the second end of the elongated pipe. An actuator valve selectively opens and closes water flow to the elongated pipe. The actuator is attached to a water supply pipe and comprises a valve.

In these respects, the bidet apparatus according to the present invention substantially departs from the conventional concepts and designs of the prior art, and in so doing provides an apparatus primarily developed for the purpose of cleaning and sanitation purposes.

SUMMARY OF THE INVENTION

In view of the foregoing disadvantages inherent in the known types of bidets now present in the prior art, the present invention provides a new bidet apparatus construction wherein the same can be utilized for cleaning and sanitation purposes.

The general purpose of the present invention, which will be described subsequently in greater detail, is to provide a new bidet apparatus apparatus and method which has many of the advantages of the bidets mentioned heretofore and many novel features that result in a new bidet apparatus which is not anticipated, rendered obvious, suggested, or even implied by any of the prior art bidets, either alone or in any combination thereof.

To attain this, the present invention generally comprises an elongated pipe having a first end and a second end. The first end is fluidly coupled to a water supply pipe. The second end is positioned in a bowl portion of a toilet bowl such that the second end is directed relatively upwardly out of the bowl portion. A nozzle is attached to the second end of the elongated pipe. An actuator valve selectively opens and closes water flow to the elongated pipe. The actuator is attached to a water supply pipe and comprises a valve.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bidet apparatus apparatus and method which has many of the advantages of the bidets mentioned heretofore and many novel features that result in a new bidet apparatus which is not anticipated, rendered obvious, suggested, or even implied by any of the prior art bidets, either alone or in any combination thereof.

It is another object of the present invention to provide a new bidet apparatus which may be easily and efficiently manufactured and marketed.

It is a further object of the present invention to provide a new bidet apparatus which is of a durable and reliable construction.

An even further object of the present invention is to provide a new bidet apparatus which is susceptible of a low cost of manufacture with regard to both materials and labor, and which accordingly is then susceptible of low prices of sale to the consuming public, thereby making such bidet apparatus economically available to the buying public.

Still yet another object of the present invention is to provide a new bidet apparatus which provides in the apparatuses and methods of the prior art some of the advantages thereof, while simultaneously overcoming some of the disadvantages normally associated therewith.

Still another object of the present invention is to provide a new bidet apparatus for cleaning and sanitation purposes.

Yet another object of the present invention is to provide a new bidet apparatus which includes an elongated pipe having a first end and a second end. The first end is fluidly coupled to a water supply pipe. The second end is positioned in a bowl portion of a toilet bowl such that the second end is directed relatively upwardly out of the bowl portion. A nozzle is attached to the second end of the elongated pipe. An actuator valve selectively opens and closes water flow to the elongated pipe. The actuator is attached to a water supply pipe and comprises a valve.

Still yet another object of the present invention is to provide a new bidet apparatus that is comprised of various components which are easily disassembled for replacing portions.

Even still another object of the present invention is to provide a new bidet apparatus that may be retrofitted to existing toilets at little cost.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
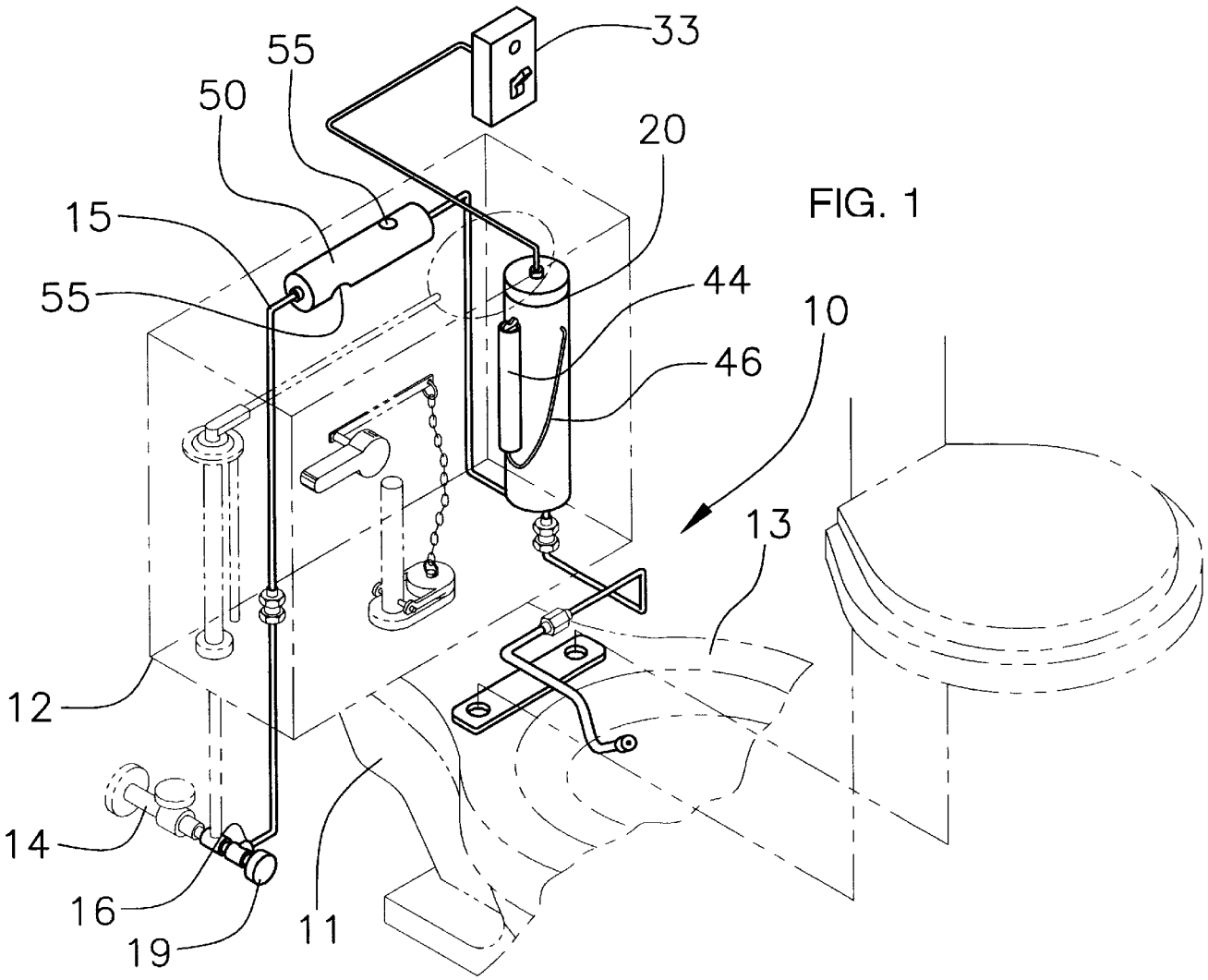
FIG. 1 is a schematic perspective in-use view of a new bidet apparatus according to the present invention.
Figure 2:
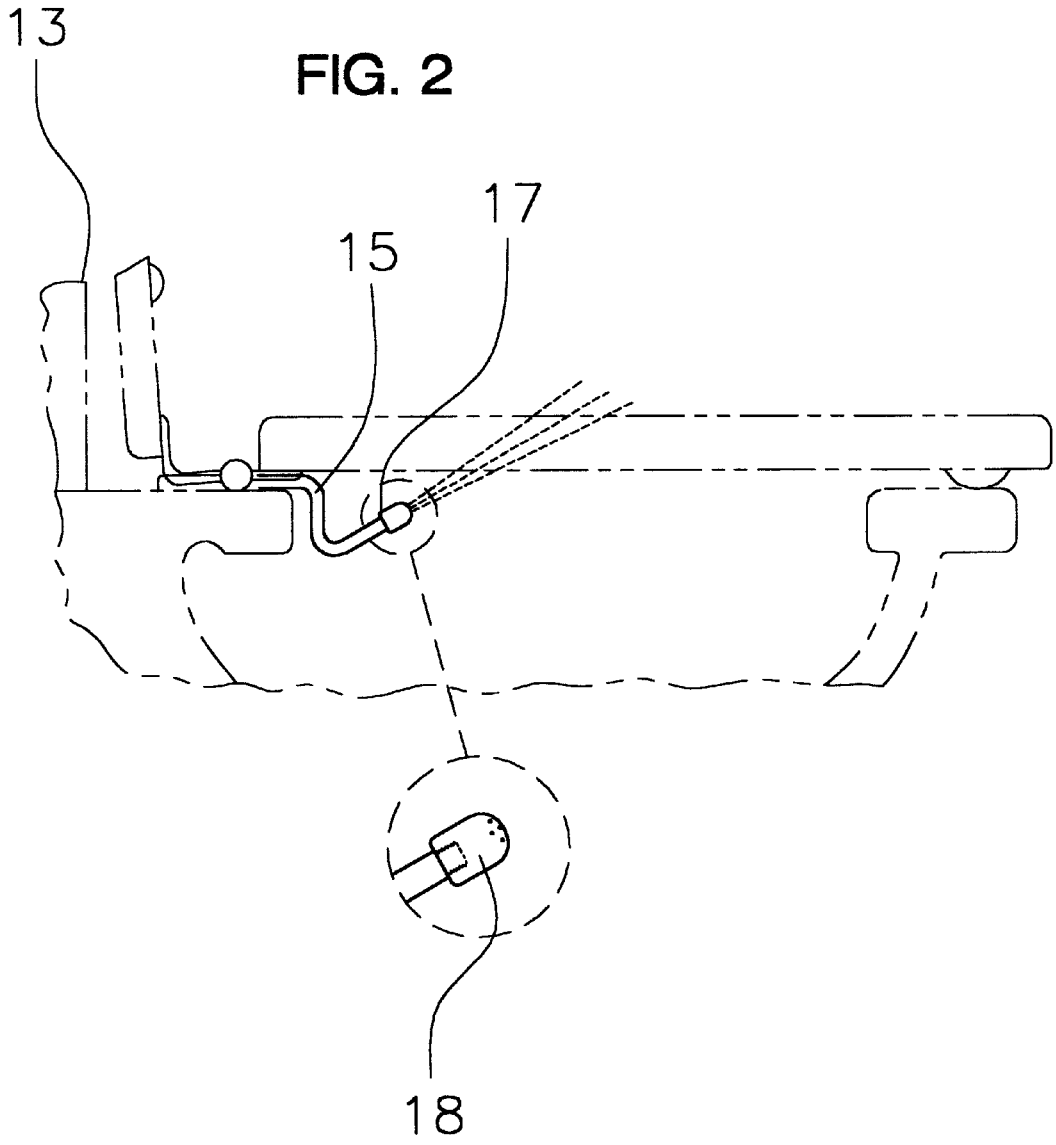
FIG. 2 is a schematic side view of the nozzle of the present invention.
Figure 3:
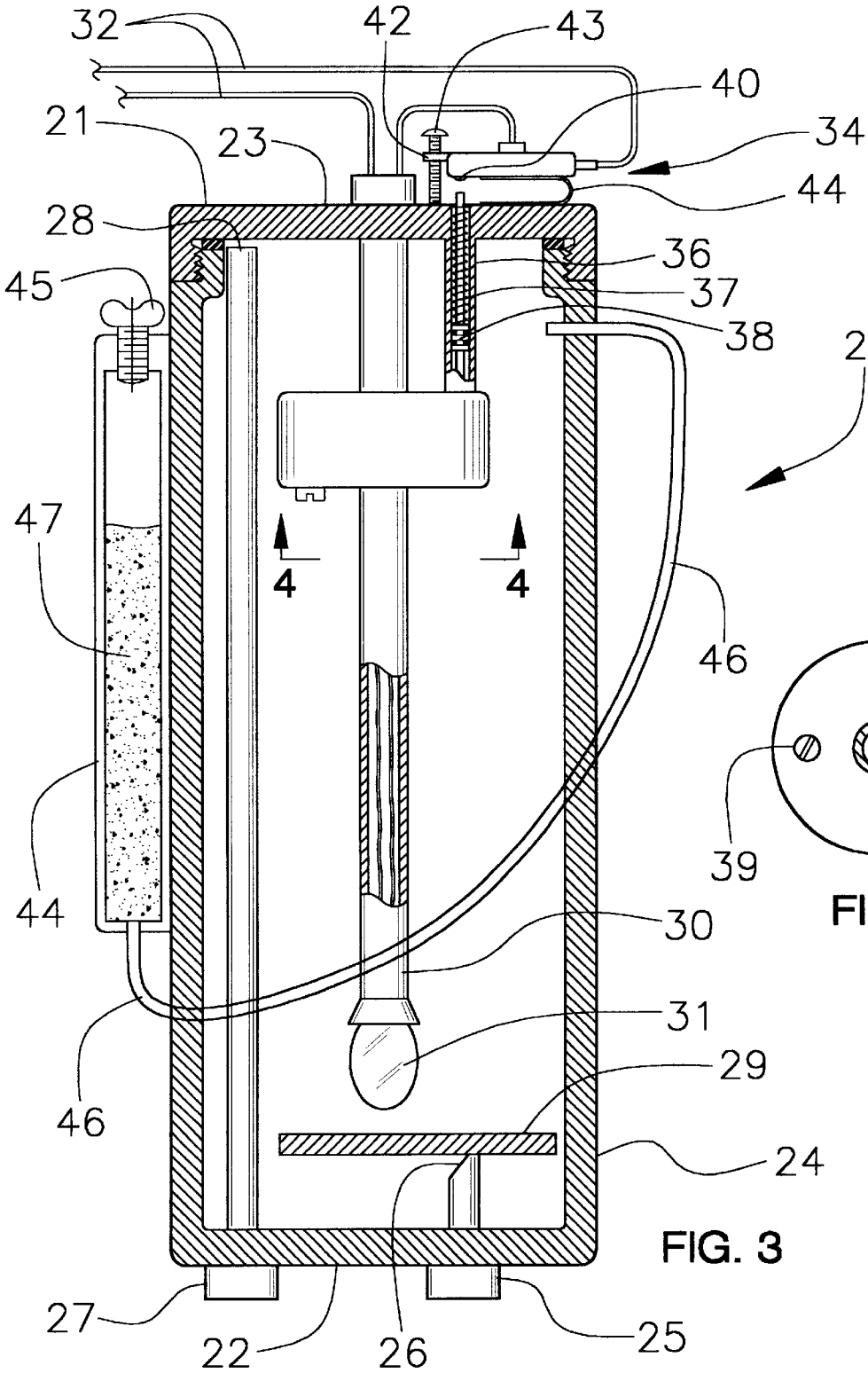
FIG. 3 is a schematic cross-sectional view of the heating device of the present invention.
Figure 4:
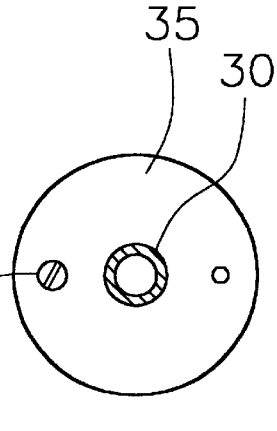
FIG. 4 is a schematic bottom view of the thermostat taken along line 4—4 of FIG. 3 of the present invention.
Figure 5:
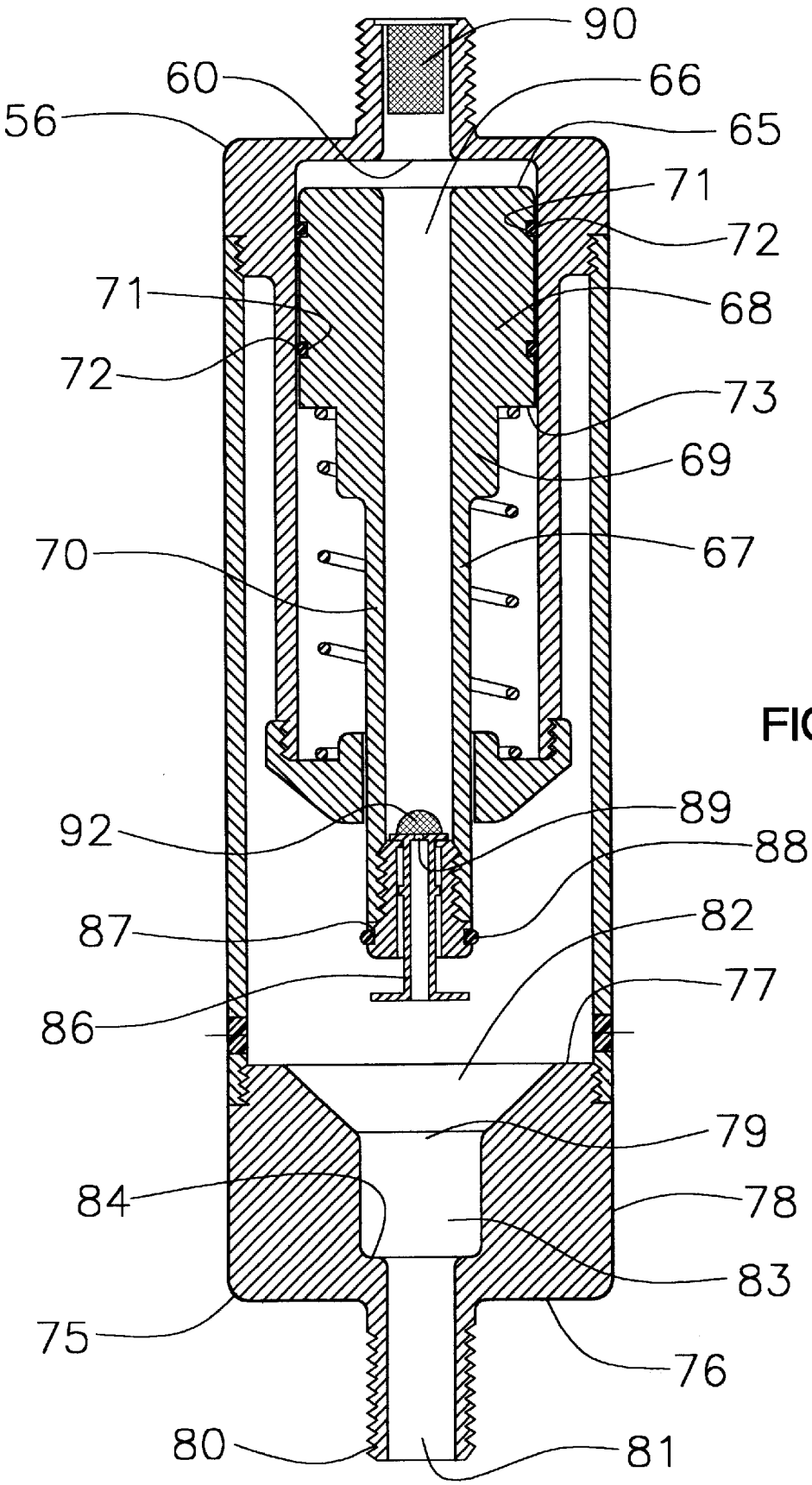
FIG. 5 is a schematic cross-sectional view of the back-flow prevention valve of the present invention.
Figure 6:
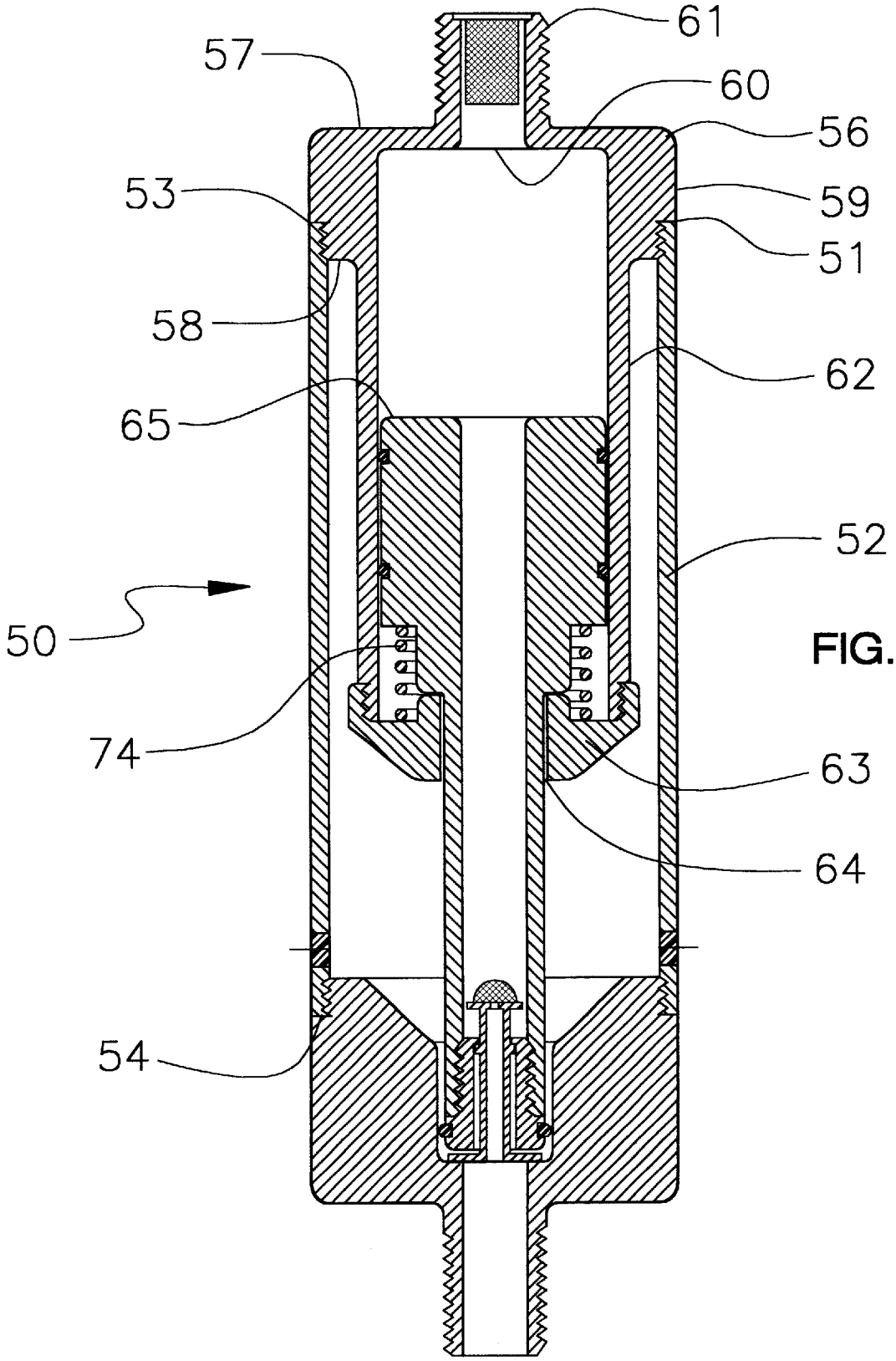
FIG. 6 is a schematic cross-sectional view of the back-flow prevention valve of the present invention.

With reference now to the drawings, and in particular to FIGS. 1 through 6 thereof, a new bidet apparatus embodying the principles and concepts of the present invention and generally designated by the reference numeral 10 will be described.

As best illustrated in FIGS. 1 through 6, the bidet apparatus 10 generally comprises an apparatus couplable to a toilet 11 having a tank portion 12 and a bowl portion 13. A water supply pipe 14 for supplying water to the toilet 11 is fluidly coupled to the tank portion 12. The apparatus 10 includes an elongated pipe 15 having a first end 16 and a second end 17. The first end 16 is fluidly coupled to the water supply pipe 14. The second end 17 is positioned in the bowl portion 13 such that the second end 17 is directed relatively upwardly out of the bowl portion 13. A nozzle 18 is attached to the second end 17 of the elongated pipe 15. The elongated pipe 15 preferably extends from the water supple pipe 14 and into the tank portion 12. The elongated pipe 15 extends outwardly through a bottom side of the tank portion 12 and across a juncture of the tank portion 12 and the bowl portion 13.

An actuator valve 19 selectively opens and closes water flow to the elongated pipe 15. The actuator valve 19 is attached to the water supply pipe 14 and comprises a conventional valve.

A heating device 20 heats water flowing through the elongated pipe 15. The heating device 20 is in fluid communication with the elongated pipe 15 and is positioned between the first 16 and second 17 ends of the elongated pipe 15. The heating device 20 is positioned in the tank portion 12 of the toilet 11. The heating device 20 comprises a housing 21 having a bottom wall 22, a top wall 23 and peripheral wall 24 extending between the top 23 and bottom 22 walls. The top 23 and bottom walls 22 are threadably coupled to the peripheral wall 24.

An inlet portion 25 of the elongated pipe 15 extends into the housing 21 through the bottom wall 22. The inlet portion 25 has an open end 26 positioned generally adjacent to the bottom wall 22. An outlet portion 27 of the elongate pipe 15 extends into the housing 21 through the bottom wall 22 and has an open end 28 positioned generally adjacent to the top wall 23.

A wall 29 is attached to an interior of the peripheral wall 24 and extends over the open end 26 of the inlet portion 25 for diffusing water flowing outward of the inlet portion. The wall 24 is located generally adjacent to the open end 26 of the inlet portion 25.

A heating element 30 is positioned in the housing 21. The heating element 20 is attached to the top wall 23 and extends toward the bottom wall 22. The heating element 30 ideally includes a quartz halogen globe 31 for heating the water and is positioned generally adjacent to the wall 29.

A power supply 32 is operationally coupled to the heating element 30. The power supply 32 is preferably hardwired to the electrical system of the dwelling.

A switch 33 selectively turns the heating element 30 on or off. The switch 33 is operationally coupled to the power supply 32 and is preferably mounted on a wall.

A thermostat 34 regulates water temperature within the housing. The thermostat 34 includes a capsule 35 positioned in the housing 21 and is located nearer the top wall 23 than the bottom wall 22. The capsule 35 is preferably comprised of a thermally conductive material such as copper.

A sleeve 36 is fluidly coupled to the capsule 35 and extends upwardly through the top wall 23. A rod 37 is slidably positioned in the sleeve 36 and has an annular rim 38 thereon for forming a seal between the rod 37 and the sleeve 36.

A thermally reactive oil is positioned in the capsule 35 such that the oil expands when heated. The rod 37 is extended upwardly through the sleeve 36 when the oil expands. The capsule may be filled through a fill hole 39 located on the bottom of the capsule.

An actuator 40 is coupled to an outer surface of the top wall by a resiliently flexible bracket 41. The flexible bracket 41 biases the actuator toward the top wall 23 and the rod 37. The actuator 40 has a protruding member 42 attached thereto. A screw 43 is threadably engaged to and extending through the protruding member 42 for selectively positioning the actuator 40 nearer or further away from the top wall 23. The heating element 30 is turned off when the rod engages the actuator 40.

A container 44 is coupled to an outer surface of the heating device 20. The container 44 has an open top end having a plug 45 therein. A hose 46 fluidly couples a bottom of the container 44 to the heating device 20. A disinfectant 47 is positioned in the container 44.

A back-flow prevention valve 50 prevents water from moving from the second end 17 of the elongated pipe 15 toward the first end 16 of the elongated pipe 15. The back flow valve 50 is fluidly coupled to the elongated pipe 15 and is positioned between the first end 16 of the elongated pipe and the heating device 20. The back-flow prevention valve 50 is positioned in the tank portion 12 of the toilet 11. The back-flow prevention valve 50 includes a housing 51 comprising a tubular body having a peripheral wall 52 extending between a first end 53 and a second end 54. Each of the first 53 and second 54 ends defines an edge of an opening. The peripheral wall 52 has at least one opening 55 therein for releasing water for reasons explained below.

A first covering 56 is positioned over the first end 53 of the tubular body, or housing 51 of the back-flow prevention valve 50. The first covering 56 has a first side 57, a second side 58 and a peripheral edge 59 extending between the first 57 and second 58 sides. The peripheral edge 59 is adapted for threadably engaging the peripheral wall 52 such that the first covering 56 covers the opening in the first end 53. The first covering 56 has an aperture 60 extending therethrough. An annular flange 61 is attached to an edge of the aperture 60 and extends away from the tubular body 51. The annular flange 61 is threaded for releasably engaging the elongated pipe 15 such that water may flow into the tubular body 51 through the first covering 56. An elongated annular lip 62 is coupled to the second side 58 of the first covering 56 and extends inward of the tubular body 51. The annular lip 62 defines a cylinder.

A cap 63 is threadably engaged to the annular lip 62. The cap 63 has an opening 64 extending therethrough, which is generally axially aligned with the aperture 60 in the first covering 56.

A piston 65 is slidably positioned in the cylinder 62. The piston 65 has a bore 66 extending therethrough along a longitudinal axis of the piston 65. The piston 65 has an outer surface 67. The piston 65 is elongated and has a distal portion 68, a middle portion 69 and a proximal portion 70 with respect to the second end 54 of the tubular body 51. The bore 66 extends through all three portions of the piston 65. The distal portion 68 has a diameter substantially equal to the annular lip 62. The outer surface 67 of the distal portion 68 has a pair of spaced depressions 71 therein extending around the piston 65. Each of a pair of seals 72 is positioned in one of the depressions 71. The middle portion 69 has a diameter smaller than the diameter of the distal portion 68 and greater than a diameter of the opening 64 in the cap 63 such that a shoulder 73 is defined between the distal 68 and middle 69 portions.

A biasing member 74 biases the piston 65 toward the aperture 60 in the first covering 56. The biasing member extends between and abuts against the shoulder and the cap. The biasing member comprises a compression spring wound about the piston.

A second covering 75 is positioned over the second end 54 of the tubular body 51. The second covering 75 has a first side 76, a second side 77 and a peripheral edge 78 extending between the first 76 and second 77 sides. The peripheral edge 78 of the second covering 75 is adapted for threadably engaging the peripheral wall 52 such that the second covering 75 covers the opening in the second end 54. The second covering 75 has an aperture 79 extending therethrough and is positioned generally co-axial with the aperture 60 in the first covering 56. An annular flange 80 is attached to an edge of the aperture 79 in the second covering 75 and extending away from the tubular body 51. The annular flange 80 on the second covering 75 is threaded for releasably engaging the elongated pipe 15 such that water may flow outwardly of the tubular body 51 through the second covering 75. The aperture 79 in the second covering 75 is divided into three portions. A first portion 81 abuts the first side 76, a second portion 82 abuts the second side 77 and a middle portion 83 is located between the first 81 and second 82 portions. The second portion 82 has a funnel shape and narrows toward the middle portion 83. The middle portion 83 and the first portion 81 each have a cylindrical shape. The middle portion 83 has a greater diameter than the first portion 81 such that a ledge 84 is defined between the first 81 and third 83 portions.

A one-way valve 86 is removably coupled to the proximal portion 67 of the piston 65. The one-way valve 86 is adapted for letting water move outwardly through proximal portion 67 of the piston 65. The one-way valve 86 has a size adapted for extending into the second 82 and middle 83 portions of the aperture 79 in the second covering 75. The one-way valve 86 is extendable between an open position retracted inward of the piston as in FIG. 6 and a closed position extending outward of the piston as in FIG. 5. The valve 86 is abuttable against the ledge 84 which moves the one-way valve 86 into the open position such that water may flow through the piston 65 and outward through the second covering 75. The one-way valve 86 has an outer surface having a groove 87 therein. A seal 88 is positioned in the groove 87 for generally forming a seal between the one-way valve 86 and the middle portion 83 of the aperture 79 when the valve 86 is located in the aperture 79. A pin-hole 89 extends through the one-way valve 86 for releasing water pressure.

A first filter 90 is removably attached to the first covering 56 and is located in the aperture 60 in the first covering 56. A second filter 92 is attached to the one-way valve 86. The second filter 92 is located within the piston 67 and covers the pin hole 89. The filters prevent the back-flow prevention valve 50 from becoming clogged with waterborne particles.

In use, the bidet 10 is used a conventional bidet. The heating device 20 brings in water from the in let portion 25 and leaves through the outlet portion 27. As the temperature of the water increases it moves toward the top wall 23 of the heating device 20. The wall 29 diffuses the water from the inlet 25 and prevents the cold water from directly mixing with the warm water. When the actuator valve 19 allows water in heating device, the pressure in the heating device rises and forces water through the tube 46 and into the container 44. When the actuator valve is closed, the pressure decreases and draws the disinfectant 47 into the heating device 20. Filling the container ⅔ full with disinfectant facilitates this process. The temperature of the water may be increased or decreased by moving the switch 40 closer or further away from the top wall 23 of the heating device 20. The back-flow prevention valve 50 prevents any water from the elongated pipe 15 from moving back into the water supply pipe 14. When the piston 65 retracts and closes the valve, any water trapped in the tubular body 51 may be released through the opening 55 in the peripheral wall 52.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A bidet apparatus for positioning in a toilet, the toilet having a tank portion and a bowl portion, a water supply pipe for supplying water to the toilet being fluidly coupled to said tank portion, said apparatus comprising:

an elongated pipe having a first end and a second end, said first end being fluidly coupled to said water supply pipe, said second end being positioned in said bowl portion such that said second end is directed relatively upwardly out of said bowl portion, a nozzle being attached to said second end of said elongated pipe;

an actuator valve for selectively opening and closing water flow to said elongated pipe, said actuator being attached to said water supply pipe and comprising a valve;

a heating device for heating water flowing through said elongated pipe, said heating device being in fluid communication with said elongated pipe and being positioned between said first and second ends of said elongated pipe;

said heating device comprising:

a housing having a bottom wall, a top wall and peripheral wall extending between said top and bottom walls, said top wall being threadably coupled to said peripheral wall;

said heating device comprising an inlet portion of said elongated pipe extending into said housing through said bottom wall;

an outlet portion of said elongate pipe extending into said housing through said bottom wall;

a heating element being positioned in said housing, said heating element being attached to said top wall and extending toward said bottom wall;

a power supply being operationally coupled to said heating element;

a thermostat for regulating water temperature within said housing;

said thermostat comprising:

a capsule being positioned in said housing and located nearer said top wall than said bottom wall;

a sleeve being fluidly coupled to said capsule and extending upwardly through said top wall;

a rod being slidably positioned in said sleeve and having annular rim thereon for forming a seal between said rod and said sleeve;

a thermally reactive oil being positioned in said capsule such that said oil expands when heated, wherein said rod is extended upwardly through said sleeve;

an actuator being coupled to an outer surface of said top wall by a resiliently flexible bracket, said flexible bracket biasing said actuator toward said top wall and said rod, said actuator having a protruding member attached thereto, a screw being threadably engaged to and extending through said protruding member for selectively positioning said actuator nearer or further away from said top wall; and wherein said heating element is turned off when said rod engages said actuator.

2. The bidet apparatus as in claim 1, wherein said heating element includes a quartz halogen globe positioned generally adjacent to said wall.

3. The bidet apparatus as in claim 1, further including:

a back-flow prevention valve for preventing water from moving from said second end of said elongated pipe to said first end of said elongated pipe, said back flow valve being fluidly coupled to said elongated pipe and being positioned between said first end of said elongated pipe and said heating device.

4. The bidet apparatus as in claim 1, wherein said inlet portion has an open end positioned generally adjacent to said bottom wall and said outlet portion having an open end positioned generally adjacent to said top wall.

5. The bidet apparatus as in claim 4, further including:

a wall being attached to an interior of said peripheral wall and extending over said open end of said inlet portion for diffusing water flowing outward of said inlet portion, said wall being located generally adjacent to said open end of said inlet portion.

6. The bidet apparatus as in claim 1, further including:

a switch for selectively turning said heating element on or off, said switch being operationally coupled to said power supply.

7. The bidet apparatus as in claim 1, further including:

a back-flow prevention valve for preventing water from moving from said second end of said elongated pipe to said first end of said elongated pipe, said back flow valve being fluidly coupled to said elongated pipe.

8. The bidet apparatus as in claim 7, wherein said back-flow prevention valve comprises:

a housing comprising a tubular body having a peripheral wall extending between a first end and a second end, each of said first and second ends defining an edge of an opening;

a first covering positioned over said first end of said tubular body, said first covering having an aperture extending therethrough, said elongated pipe being fluidly coupled to said aperture, an elongated annular lip being coupled to said first covering and extending inward of said tubular body and defining a cylinder;

a cap covering said annular lip and having an opening extending therethrough;

a piston being slidably positioned in said cylinder, said piston having a bore extending therethrough along a longitudinal axis of said piston;

a biasing member for biasing said piston toward said aperture in said first covering;

a second covering for positioning over said second end of said tubular body, said second covering having an aperture extending therethrough being positioned generally co-axial with said aperture in said first covering, said aperture in said second covering having a ledge therein; and a one-way valve being removably coupled to a proximal end of said piston with respect to said second covering, said one-way valve being adapted for letting water move outwardly through said piston, said one-way valve having a size adapted for extending into said aperture in said second covering, said one-way valve being extendable between an open position retracted inward of said piston and a closed position extending outward of said piston, said one-way valve being abuttable against said ledge such that said one-way valve is moved into said open position such that water may flow through said piston and outward through said second covering.

9. The bidet apparatus as in claim 8, wherein said piston has an outer surface, said piston being elongated and having a distal portion, a middle portion and a proximal portion with respect to said second end of said tubular body, wherein said bore extends through all three portions of said piston, said distal portion having a diameter substantially equal to said annular lip, said middle portion having a diameter smaller than said diameter of said distal portion and greater than a diameter of said opening in said cap such that a shoulder is defined between said distal and middle portions.

10. The bidet apparatus as in claim 9, wherein said outer surface of said distal portion has an a pair of spaced depressions therein extending around said piston, each of a pair of seals being positioned in one of said depressions.

11. The bidet apparatus as in claim 9, wherein said biasing member extends between and abutting against said shoulder and said cap, said biasing member comprising a compression spring wound about said piston.

12. The bidet apparatus as in claim 8, wherein said second covering has a first side facing outward of said tubular body and a second side facing inward of said tubular body, said aperture in said second covering having a first portion abutting said first side, a second portion abutting said second side and a middle portion located between said first and second portions, said second portion having a funnel shape and narrowing toward said middle portion, said middle portion and said first portions having a cylindrical shape, said middle portion having a greater diameter than said first portion such that said ledge is defined between said first and third portions.

13. The bidet apparatus as in claim 8, wherein said one-way valve has an outer surface having a groove therein, a seal being positioned in said groove for generally forming a seal between said one-way valve and said middle portion of said aperture when said one-way valve is located in said aperture in said second covering.

14. The bidet apparatus as in claim 8, wherein a pin-hole extends through said one-way valve for releasing water pressure.

15. The bidet apparatus as in claim 14, further including:

a first filter being attached to said first covering and being located in said aperture in said first covering;

a second filter being attached to said one-way valve, said second filter being located within said piston and covering said pin hole.

16. A bidet apparatus for positioning in a toilet, the toilet having a tank portion and a bowl portion, a water supply pipe for supplying water to the toilet being fluidly coupled to said tank portion, said apparatus comprising:

an elongated pipe having a first end and a second end, said first end being fluidly coupled to said water supply pipe, said second end being positioned in said bowl portion such that said second end is directed relatively upwardly out of said bowl portion, a nozzle being attached to said second end of said elongated pipe;

an actuator valve for selectively opening and closing water flow to said elongated pipe, said actuator being attached to said water supply pipe and comprising a valve;

a back-flow prevention valve for preventing water from moving from said second end of said elongated pipe to said first end of said elongated pipe, said back flow valve being fluidly coupled to said elongated pipe;

said back-flow prevention valve comprising:

a housing comprising a tubular body having a peripheral wall extending between a first end and a second end, each of said first and second ends defining an edge of an opening;

a first covering positioned over said first end of said tubular body, said first covering having an aperture extending therethrough, said elongated pipe being fluidly coupled to said aperture, an elongated annular lip being coupled to said first covering and extending inward of said tubular body and defining a cylinder;

a cap covering said annular lip and having an opening extending therethrough;

a piston being slidably positioned in said cylinder, said piston having a bore extending therethrough along a longitudinal axis of said piston;

a biasing member for biasing said piston toward said aperture in said first covering;

a second covering for positioning over said second end of said tubular body, said second covering having an aperture extending therethrough being positioned generally co-axial with said aperture in said first covering, said aperture in said second covering having a ledge therein; and a one-way valve being removably coupled to a proximal end of said piston with respect to said second covering, said one-way valve being adapted for letting water move outwardly through said piston, said one-way valve having a size adapted for extending into said aperture in said second covering, said one-way valve being extendable between an open position retracted inward of said piston and a closed position extending outward of said piston, said one-way valve being abuttable against said ledge such that said one-way valve is moved into said open position such that water may flow through said piston and outward through said second covering.

17. The bidet apparatus as in claim 16, wherein said one-way valve has an outer surface having a groove therein, a seal being positioned in said groove for generally forming a seal between said one-way valve and said middle portion of said aperture when said one-way valve is located in said aperture in said second covering.

18. The bidet apparatus as in claim 16, wherein a pin-hole extends through said one-way valve for releasing water pressure.

19. The bidet apparatus as in claim 18, further including:

a first filter being attached to said first covering and being located in said aperture in said first covering;

a second filter being attached to said one-way valve, said second filter being located within said piston and covering said pin hole.

20. A bidet apparatus for positioning in a toilet, the toilet having a tank portion and a bowl portion, a water supply pipe for supplying water to the toilet being fluidly coupled to said tank portion, said apparatus comprising:

an elongated pipe having a first end and a second end, said first end being fluidly coupled to said water supply pipe, said second end being positioned in said bowl portion such that said second end is directed relatively upwardly out of said bowl portion, a nozzle being attached to said second end of said elongated pipe, said elongated pipe extending from said water supple pipe and into said tank portion, said elongated pipe extending outwardly through a bottom side of said tank portion and across a juncture of said tank portion and said bowl portion;

an actuator valve for selectively opening and closing water flow to said elongated pipe, said actuator being attached to said water supply pipe and comprising a valve;

a heating device for heating water flowing through said elongated pipe, said heating device being in fluid communication with said elongated pipe and being positioned between said first and second ends of said elongated pipe, said heating device being positioned in said tank portion of said toilet, said heating device comprising;

a housing having a bottom wall, a top wall and peripheral wall extending between said top and bottom walls, said top wall being threadably coupled to said peripheral wall;

an inlet portion of said elongated pipe extending into said housing through said bottom wall, said inlet portion having an open end positioned generally adjacent to said bottom wall;

an outlet portion of said elongate pipe extending into said housing through said bottom wall, said outlet portion having an open end positioned generally adjacent to said top wall;

a wall being attached to an interior of said peripheral wall and extending over said open end of said inlet portion for diffusing water flowing outward of said inlet portion, said wall being located generally adjacent to said open end of said inlet;

a heating element being positioned in said housing, said heating element being attached to said top wall and extending toward said bottom wall, said heating element including a quartz halogen globe positioned generally adjacent to said wall;

a power supply being operationally coupled to said heating element;

a switch for selectively turning said heating element on or off, said switch being operationally coupled to said power supply;

a thermostat for regulating water temperature within said housing, said thermostat comprising;

a capsule being positioned in said housing and located nearer said top wall than said bottom wall;

a sleeve being fluidly coupled to said capsule and extending upwardly through said top wall;

a rod being slidably positioned in said sleeve and having annular rim thereon for forming a seal between said rod and said sleeve;

a thermally reactive oil being positioned in said capsule such that said oil expands when heated, wherein said rod is extended upwardly through said sleeve;

an actuator being coupled to an outer surface of said top wall by a resiliently flexible bracket, said flexible bracket biasing said actuator toward said top wall and said rod, said actuator having a protruding member attached thereto, a screw being threadably engaged to and extending through said protruding member for selectively positioning said actuator nearer or further away from said top wall;

wherein said heating element is turned off when said rod engages said actuator;

a container being coupled to an outer surface of the heating device, the container having an open top end having a plug thereon, a hose fluidly couples a bottom of the container to the heating device, a liquid disinfectant is positioned in the container;

a back-flow prevention valve for preventing water from moving from said second end of said elongated pipe to said first end of said elongated pipe, said back flow valve being fluidly coupled to said elongated pipe and being positioned between said first end of said elongated pipe and said heating device, said back-flow prevention valve being positioned in said tank portion of said toilet, said back-flow prevention valve comprising;

a housing comprising a tubular body having a peripheral wall extending between a first end and a second end, each of said first and second ends defining an edge of an opening, said peripheral wall having at least one opening therein;

a first covering for positioning over said first end of said tubular body, said first covering having a first side, a second side and a peripheral edge extending between said first and second sides, said peripheral edge being adapted for threadably engaging said peripheral wall such that said first covering covers said opening in said first end, said first covering having an aperture extending therethrough, an annular flange being attached to an edge of said aperture and extending away from said tubular body, said annular flange being threaded for releasably engaging said elongated pipe such that water may flow into said tubular body through said first covering, an elongated annular lip being coupled to said second side of said first covering and extending inward of said tubular body, said annular lip defining a cylinder;

a cap being threadably engaged to said annular lip, said cap having an opening extending therethrough and being generally axially aligned with said aperture with said first covering;

a piston being slidably positioned in said cylinder, said piston having a bore extending therethrough along a longitudinal axis of said piston, said piston having an outer surface, said piston being elongated and having a distal portion, a middle portion and a proximal portion with respect to said second end of said tubular body, wherein said bore extends through all three portions of said piston, said distal portion having a diameter substantially equal to said annular lip, said outer surface of said distal portion having an a pair of spaced depressions therein extending around said piston, each of a pair of seals being positioned in one of said depressions, said middle portion having a diameter smaller than said diameter of said distal portion and greater than a diameter of said opening in said cap such that a shoulder is defined between said distal and middle portions;

a biasing member for biasing said piston toward said aperture in said first covering, said biasing member extending between and abutting against said shoulder and said cap, said biasing member comprising a compression spring wound about said piston;

a second covering for positioning over said second end of said tubular body, said second covering having a first side, a second side and a peripheral edge extending between said first and second sides, said peripheral edge of said second covering being adapted for threadably engaging said peripheral wall such that said second covering covers said opening in said second end, said second covering having an aperture extending therethrough being positioned generally co-axial with said aperture in said first covering, an annular flange being attached to an edge of said aperture in said second covering and extending away from said tubular body, said annular flange on said second covering being threaded for releasably engaging said elongated pipe such that water may flow outwardly of said tubular body through said second covering, said aperture in said second covering having a first portion abutting said first side, a second portion abutting said second side and a middle portion located between said first and second portions, said second portion having a funnel shape and narrowing toward said middle portion, said middle portion and said first portions having a cylindrical shape, said middle portion having a greater diameter than said first portion such that a ledge is defined between said first and third portions;

a one-way valve being removably coupled to said proximal portion of said piston, said one-way valve being adapted for letting water move outwardly through proximal portion of said piston, said one-way valve having a size adapted for extending into said second and middle portions of said aperture in said second covering, said one-way valve being extendable between an open position retracted inward of said piston and a closed position extending outward of said piston, said valve being abuttable against said ledge such that the one-way valve is biased into said open position such that water may flow through said piston and outward through said second covering, said one-way valve having an outer surface having a groove therein, a seal being positioned in said groove for generally forming a seal between said one-way valve and said middle portion of said aperture when said valve is located in said aperture, a pin-hole extending through said one-way valve for releasing water pressure;

a first filter being attached to said first covering and being located in said aperture in said first covering; and a second filter being attached to said one-way valve, said second filter being located within said piston and covering said pin hole.

* * * * *